US009200587B2

(12) United States Patent
Serrano

(10) Patent No.: US 9,200,587 B2
(45) Date of Patent: Dec. 1, 2015

(54) LOOK-UP TABLE BASED SKIP FIRE ENGINE CONTROL

(71) Applicant: Tula Technology, Inc., San Jose, CA (US)

(72) Inventor: Louis J. Serrano, Los Gatos, CA (US)

(73) Assignee: Tula Technology, Inc., San Jose, CA (US)

( * ) Notice: Subject to any disclaimer, the term of this patent is extended or adjusted under 35 U.S.C. 154(b) by 358 days.

(21) Appl. No.: 13/774,134

(22) Filed: Feb. 22, 2013

(65) Prior Publication Data

US 2013/0289853 A1 Oct. 31, 2013

Related U.S. Application Data

(60) Provisional application No. 61/639,500, filed on Apr. 27, 2012, provisional application No. 61/672,144, filed on Jul. 16, 2012.

(51) Int. Cl.

| | |
|---|---|
| ***F02D 45/00*** | (2006.01) |
| ***F02D 41/00*** | (2006.01) |
| ***F02D 11/10*** | (2006.01) |

(52) U.S. Cl.

CPC ..... *F02D 45/00* (2013.01); *F02D 11/105* (2013.01); *F02D 41/0087* (2013.01)

(58) Field of Classification Search

CPC ..... F02D 45/00; F02D 41/0087

USPC ..... 701/110, 101, 102, 103, 105, 106, 107, 701/111, 115, 53, 54, 56, 57, 58, 59, 60, 65, 701/70, 84, 86; 123/332, 334, 339.16, 123/339.2, 349, 350, 370, 371, 406.11, 123/406.12, 406.2, 406.23, 406.24, 406.25, 123/406.26, 406.33, 406.35, 406.36, 481, 123/480, 492, 493

See application file for complete search history.

(56) References Cited

U.S. PATENT DOCUMENTS

| | | | | |
|---|---|---|---|---|
| 2,771,867 | A | 11/1956 | Péras | |
| 2,875,742 | A | 3/1959 | Dolza | |
| 3,756,205 | A | 9/1973 | Frost | |
| 4,064,844 | A | 12/1977 | Matsumoto et al. | |
| 4,129,109 | A * | 12/1978 | Matsumoto | F02D 41/0087 123/198 F |
| 4,142,493 | A * | 3/1979 | Schira | F02D 41/0077 123/486 |
| 4,165,610 | A * | 8/1979 | Iizuka | F02D 41/0087 123/198 F |
| 4,172,434 | A | 10/1979 | Coles | |
| 4,197,767 | A * | 4/1980 | Leung | F02D 35/023 123/179.16 |

(Continued)

OTHER PUBLICATIONS

Klauer, "Lehrstuhl für Angewandte Thermodyamik," Diploma work Rheinish-Westfälischen Technischen, Aachen, Germany, published Mar. 1983.

*Primary Examiner* — Hung Q Nguyen
*Assistant Examiner* — John Bailey
(74) *Attorney, Agent, or Firm* — Beyer Law Group LLP

(57) ABSTRACT

A variety of skip fire engine controllers and control methods are described that utilize look-up tables, state machines, or other data structures to determine the sequence or ordering of skip-fire firings. In one aspect, a skip fire engine controller utilizes a look-up table to determine when firings are appropriate to deliver a desired engine output. In some embodiments, a firing timing controller tracks a value indicative of the portion of a firing that has been requested, but not yet directed and such information is utilized in the determination of the timing of the firings. The accumulator value is particularly useful when transitioning between different requested firing fractions.

29 Claims, 5 Drawing Sheets

(56) References Cited

U.S. PATENT DOCUMENTS 4,274,382 A 6/1981 Sugasawa et al.
4,276,863 A 7/1981 Sugasawa et al.
4,338,666 A * 7/1982 Suzuki ..... F16H 61/0213 477/120
4,380,048 A * 4/1983 Kishi ..... F16H 61/0213 477/120
4,391,255 A 7/1983 Staerzl
4,434,767 A 3/1984 Kohama et al.
4,452,204 A 6/1984 Matsubara
4,489,695 A 12/1984 Kohama et al.
4,509,488 A 4/1985 Forster et al.
4,541,387 A 9/1985 Morikawa
4,715,012 A * 12/1987 Mueller, Jr. ..... A01B 63/112 701/50
4,886,030 A * 12/1989 Oba ..... F02D 41/32 123/406.65
5,117,790 A 6/1992 Clarke et al.
5,267,541 A * 12/1993 Taguchi ..... F02D 41/0002 123/198 F
5,374,224 A 12/1994 Huffmaster et al.
5,377,631 A 1/1995 Schechter
5,408,966 A 4/1995 Lipinski et al.
5,408,974 A 4/1995 Lipinski et al.
5,431,139 A 7/1995 Grutter et al.
5,540,633 A * 7/1996 Yamanaka ..... F02D 11/105 123/198 F
5,553,575 A * 9/1996 Beck ..... F02B 37/16 123/198 F
5,584,266 A 12/1996 Motose et al.
5,617,829 A * 4/1997 Bidner ..... F02D 41/0087 123/481
5,645,032 A * 7/1997 Motose ..... F02D 17/02 123/339.16
5,690,073 A 11/1997 Fuwa
5,720,257 A * 2/1998 Motose ..... F02D 41/0087 123/339.14
5,749,346 A * 5/1998 Halvorson ..... F02D 41/1406 123/486
5,769,054 A 6/1998 Schnaibel et al.
5,778,329 A * 7/1998 Officer ..... F16H 59/14 123/564
5,778,858 A 7/1998 Garabedian
5,797,371 A * 8/1998 Nonaka ..... F02D 17/02 123/406.23
5,826,563 A * 10/1998 Patel ..... F02D 41/0087 123/198 F
5,918,225 A * 6/1999 White ..... G06F 17/30324
5,975,052 A 11/1999 Moyer
6,158,411 A 12/2000 Morikawa
6,244,242 B1 6/2001 Grizzle et al.
6,360,724 B1 * 3/2002 Suhre ..... F02D 17/02 123/198 F
6,363,907 B1 * 4/2002 Arai ..... F01L 9/04 123/198 F
6,408,625 B1 6/2002 Woon et al.
6,499,449 B2 * 12/2002 Michelini ..... F02D 37/02 123/198 F
6,542,790 B1 * 4/2003 Loucks ..... G05B 13/024 700/189
6,585,621 B2 * 7/2003 Matthews ..... B60W 10/11 123/198 F
6,615,804 B2 * 9/2003 Matthews ..... F02D 17/02 123/198 F
6,619,258 B2 9/2003 McKay et al.
6,619,267 B1 * 9/2003 Pao ..... F02B 75/22 123/184.25
6,647,947 B2 * 11/2003 Boyer ..... F01L 1/34 123/198 F
6,687,602 B2 * 2/2004 Ament ..... F02D 11/105 123/198 F
6,701,903 B1 * 3/2004 Collins ..... F02D 13/0215 123/568.14
6,735,938 B2 5/2004 Surnilla
6,736,108 B2 * 5/2004 Rayl ..... F02B 75/22 123/198 F
6,752,121 B2 * 6/2004 Rayl ..... F01L 13/0005 123/198 F
6,782,865 B2 * 8/2004 Rayl ..... F02D 17/02 123/198 F
6,950,712 B2 * 9/2005 Ulyanov ..... G05B 13/0285 700/28
6,957,137 B2 * 10/2005 Hubbard ..... B60W 10/06 180/65.22
7,013,866 B1 * 3/2006 Prucka ..... F02D 41/10 123/319
7,021,273 B1 * 4/2006 Prucka ..... F02F 7/0019 123/198 F
7,025,035 B1 * 4/2006 Duty ..... F01L 13/0005 123/198 F
7,032,581 B2 4/2006 Gibson et al.
7,044,101 B1 * 5/2006 Duty ..... F02D 17/02 123/198 F
7,063,062 B2 6/2006 Lewis et al.
7,086,386 B2 8/2006 Doering
7,110,871 B2 * 9/2006 Hubbard ..... B60W 10/06 180/65.235
7,165,391 B2 * 1/2007 Lewis ..... F02D 13/06 123/90.15
7,179,199 B2 2/2007 Kushiyama et al.
7,198,029 B1 * 4/2007 Wong ..... F02D 13/06 123/198 F
7,206,689 B1 * 4/2007 Johnson ..... B60W 10/06 701/103
7,231,907 B2 * 6/2007 Bolander ..... F02D 13/06 123/198 F
7,249,583 B2 * 7/2007 Bidner ..... F01L 13/00 123/198 DB
7,260,467 B2 * 8/2007 Megli ..... F02D 13/0215 701/101
7,278,391 B1 10/2007 Wong et al.
7,546,827 B1 * 6/2009 Wade ..... F01L 1/181 123/198 F
7,549,408 B2 * 6/2009 Russell ..... F02D 13/06 123/198 A
7,571,707 B2 * 8/2009 Gibson ..... F02D 41/307 123/198 F
7,577,511 B1 * 8/2009 Tripathi ..... F02D 41/0087 701/103
7,835,848 B1 * 11/2010 Rollinger ..... F01L 1/34 123/198 F
7,836,866 B2 11/2010 Luken et al.
7,900,509 B2 * 3/2011 Feldkamp ..... G01M 15/042 73/114.79
7,930,087 B2 4/2011 Gibson et al.
8,099,224 B2 1/2012 Tripathi et al.
8,511,281 B2 * 8/2013 Tripathi ..... F02D 17/02 123/481
2001/0037793 A1 * 11/2001 Robichaux ..... F02D 41/0087 123/339.19
2002/0195087 A1 * 12/2002 Dunsworth ..... F02D 17/02 123/481
2003/0131820 A1 * 7/2003 Mckay ..... F01L 13/0005 123/198 F
2005/0257778 A1 * 11/2005 Albertson ..... F02D 41/0087 123/481
2007/0051351 A1 * 3/2007 Pallett ..... F02D 17/02 123/692
2008/0154468 A1 * 6/2008 Berger ..... B60K 6/365 701/54
2008/0276904 A1 * 11/2008 Surnilla ..... F02D 41/0082 123/406.45
2009/0066551 A1 * 3/2009 Mace ..... H03M 1/0881 341/144
2010/0010724 A1 * 1/2010 Tripathi ..... F02D 41/0087 701/103
2010/0012053 A1 * 1/2010 Surnilla ..... B60W 10/11 123/21
2010/0012072 A1 * 1/2010 Leone ..... F02D 41/0087 123/192.1
2010/0024769 A1 * 2/2010 McDonald ..... B60W 10/06 123/406.21
2010/0031738 A1 * 2/2010 Feldkamp ..... G01M 15/042 73/114.79

(56) References Cited

U.S. PATENT DOCUMENTS

2010/0037857 A1* 2/2010 Tripathi ..... F02D 41/0087 123/406.19
2010/0043744 A1 2/2010 Suzuki et al.
2010/0050993 A1 3/2010 Zhao et al.
2010/0175463 A1* 7/2010 Doering ..... F02D 13/06 73/114.37
2010/0211297 A1* 8/2010 Doering ..... F02D 13/06 701/112
2010/0280722 A1* 11/2010 Frank ..... B60K 6/36 701/55
2011/0000459 A1 1/2011 Elsäβer
2011/0030657 A1* 2/2011 Tripathi ..... F02D 17/02 123/481
2011/0130902 A1 6/2011 Heisel et al.
2011/0213540 A1* 9/2011 Tripathi ..... F02D 37/02 701/102
2011/0220068 A1* 9/2011 Ferch ..... F02D 17/02 123/481
2011/0265453 A1* 11/2011 Uhrich ..... F01N 3/0842 60/274
2011/0265454 A1* 11/2011 Smith ..... F01N 3/0842 60/274
2012/0010732 A1* 1/2012 Stewart ..... G05B 15/02 700/19
2012/0253631 A1* 10/2012 Li ..... F16H 61/465 701/99
2013/0006497 A1* 1/2013 Silvers ..... F02D 41/3058 701/103
2013/0066502 A1* 3/2013 Yuille ..... B60W 10/06 701/22
2013/0092127 A1* 4/2013 Pirjaberi ..... F02D 41/0087 123/406.23
2013/0096758 A1* 4/2013 Yuille ..... B60W 10/06 701/22
2013/0255626 A1* 10/2013 Serrano ..... F02D 41/0087 123/350
2013/0289853 A1* 10/2013 Serrano ..... F02D 45/00 701/110
2014/0041625 A1* 2/2014 Pirjaberi ..... F02D 41/00 123/349
2014/0041630 A1* 2/2014 Carlson ..... F02P 9/00 123/406.12
2014/0041641 A1* 2/2014 Carlson ..... F02M 25/08 123/520
2014/0053802 A1 2/2014 Rayl
2014/0053804 A1 2/2014 Rayl et al.
2014/0053805 A1 2/2014 Brennan et al.
2014/0069178 A1 3/2014 Beikmann
2014/0069378 A1* 3/2014 Burleigh ..... F02D 41/0087 123/350
2014/0069379 A1* 3/2014 Beikmann ..... F02D 41/0087 123/350
2014/0090623 A1* 4/2014 Beikmann ..... F02D 41/0087 123/350
2014/0102411 A1 4/2014 Brennan
2014/0163839 A1* 6/2014 Staley ..... F02D 17/02 701/103

* cited by examiner

400

| Row # | Firing Fraction | Index Increment | Firing decision, Index | | | | | | | | | | | | | | | |
|---|---|---|---|---|---|---|---|---|---|---|---|---|---|---|---|---|---|---|
| 1 | 1/16 | 1 | 1,0 | 0,1 | 0,2 | 0,3 | 0,4 | 0,5 | 0,6 | 0,7 | 0,8 | 0,9 | 0,10 | 0,11 | 0,12 | 0,13 | 0,14 | 0,15 |
| 2 | 1/8 | 2 | 1,0 | 0,2 | 0,4 | 0,6 | 0,8 | 0,10 | 0,12 | 0,14 | | | | | | | | |
| 3 | 1/8 | 2 | 1,1 | 0,3 | 0,5 | 0,7 | 0,9 | 0,11 | 0,13 | 0,15 | | | | | | | | |
| 4 | 3/16 | 3 | 1,0 | 0,3 | 0,6 | 0,9 | 0,12 | 0,15 | 1,2 | 0,5 | 0,8 | 0,11 | 0,14 | 1,1 | 0,4 | 0,7 | 0,10 | 0,13 |
| 5 | 1/4 | 4 | 1,0 | 0,4 | 0,8 | 0,12 | | | | | | | | | | | | |
| 6 | 1/4 | 4 | 1,1 | 0,5 | 0,9 | 0,13 | | | | | | | | | | | | |
| 7 | 1/4 | 4 | 1,2 | 0,6 | 0,10 | 0,14 | | | | | | | | | | | | |
| 8 | 1/4 | 4 | 1,3 | 0,7 | 0,11 | 0,15 | | | | | | | | | | | | |
| 9 | 5/16 | 5 | 1,0 | 0,5 | 0,10 | 0,15 | 1,4 | 0,9 | 0,14 | 1,3 | 0,8 | 0,13 | 1,2 | 0,7 | 0,12 | 1,1 | 0,6 | 0,11 |
| 10 | 3/8 | 6 | 1,0 | 0,6 | 0,12 | 1,2 | 0,8 | 0,14 | 1,4 | 0,10 | | | | | | | | |
| 11 | 3/8 | 6 | 1,1 | 0,7 | 0,13 | 1,3 | 0,9 | 0,15 | 1,5 | 0,11 | | | | | | | | |
| 12 | 7/16 | 7 | 1,0 | 0,7 | 0,14 | 1,5 | 0,12 | 1,3 | 0,10 | 1,1 | 0,8 | 0,15 | 1,6 | 0,13 | 1,4 | 0,11 | 1,2 | 0,9 |
| 13 | 1/2 | 8 | 1,0 | 0,8 | | | | | | | | | | | | | | |
| 14 | 1/2 | 8 | 1,1 | 0,9 | | | | | | | | | | | | | | |
| 15 | 1/2 | 8 | 1,2 | 0,10 | | | | | | | | | | | | | | |
| 16 | 1/2 | 8 | 1,3 | 0,11 | | | | | | | | | | | | | | |
| 17 | 1/2 | 8 | 1,4 | 0,12 | | | | | | | | | | | | | | |
| 18 | 1/2 | 8 | 1,5 | 0,13 | | | | | | | | | | | | | | |
| 19 | 1/2 | 8 | 1,6 | 0,14 | | | | | | | | | | | | | | |
| 20 | 1/2 | 8 | 1,7 | 0,15 | | | | | | | | | | | | | | |
| 21 | 9/16 | 9 | 1,0 | 0,9 | 1,2 | 0,11 | 1,4 | 0,13 | 1,6 | 0,15 | 1,8 | 1,1 | 0,10 | 1,3 | 0,12 | 1,5 | 0,14 | 1,7 |
| 22 | 5/8 | 10 | 1,0 | 0,10 | 1,4 | 0,14 | 1,8 | 0,2 | 0,12 | 1,6 | | | | | | | | |
| 23 | 5/8 | 10 | 1,1 | 0,11 | 1,5 | 0,15 | 1,9 | 0,3 | 0,13 | 1,7 | | | | | | | | |
| 24 | 11/16 | 11 | 1,0 | 0,11 | 1,6 | 1,1 | 0,12 | 1,7 | 0,2 | 0,13 | 1,8 | 1,3 | 0,14 | 1,9 | 1,4 | 0,15 | 1,10 | 1,5 |
| 25 | 3/4 | 12 | 1,0 | 0,12 | 1,8 | 1,4 | | | | | | | | | | | | |
| 26 | 3/4 | 12 | 1,1 | 0,13 | 1,9 | 1,5 | | | | | | | | | | | | |
| 27 | 3/4 | 12 | 1,2 | 0,14 | 1,10 | 1,6 | | | | | | | | | | | | |
| 28 | 3/4 | 12 | 1,3 | 0,15 | 1,11 | 1,7 | | | | | | | | | | | | |
| 29 | 13/16 | 13 | 1,0 | 0,13 | 1,10 | 1,7 | 1,4 | 1,1 | 0,14 | 1,11 | 1,8 | 1,5 | 1,2 | 0,15 | 1,12 | 1,9 | 1,6 | 1,3 |
| 30 | 7/8 | 14 | 1,0 | 0,14 | 1,12 | 1,10 | 1,8 | 1,6 | 1,4 | 1,2 | | | | | | | | |
| 31 | 7/8 | 14 | 1,1 | 0,15 | 1,13 | 1,11 | 1,9 | 1,7 | 1,5 | 1,3 | | | | | | | | |
| 32 | 15/16 | 15 | 1,0 | 0,15 | 1,14 | 1,13 | 1,12 | 1,11 | 1,10 | 1,9 | 1,8 | 1,7 | 1,6 | 1,5 | 1,4 | 1,3 | 1,2 | 1,1 |

403 404 405 406 407 409 411 402 475 477 474

FIG. 4

LOOK-UP TABLE BASED SKIP FIRE ENGINE CONTROL

CROSS REFERENCE TO RELATED APPLICATIONS

This application claims priority of Provisional Application Nos. 61/639,500 filed Apr. 27, 2012 and 61/672,144 filed Jul. 16, 2012 each of which is incorporated herein by reference.

FIELD OF THE INVENTION

The present invention relates generally to skip fire control of internal combustion engines and particularly to the use of structures such as look-up tables to determine the firing sequence.

BACKGROUND

Most vehicles in operation today (and many other devices) are powered by internal combustion (IC) engines. Internal combustion engines typically have a plurality of cylinders or other working chambers where combustion occurs. Under normal driving conditions, the torque generated by an internal combustion engine needs to vary over a wide range in order to meet the operational demands of the driver. Over the years, a number of methods of controlling internal combustion engine torque have been proposed and utilized. In most gasoline engines, the output of the engine is primarily modulated by controlling the amount of air (and corresponding amount of fuel) delivered to the working chambers. In many diesel engines, the output is modulated primarily by controlling the amount of fuel delivered to the working chambers.

Some approaches seek to improve the thermodynamic efficiency of the engine by varying the effective displacement of the engine. Most commercially available variable displacement engines are arranged to deactivate a fixed set of the cylinders during certain low-load operating conditions. When a cylinder is deactivated, its piston typically still reciprocates, however neither air nor fuel is delivered to the cylinder so the piston does not deliver any power during its power stroke. Since the cylinders that are "shut down" don't deliver any power, the proportionate load on the remaining cylinders is increased, thereby allowing the remaining cylinders to operate at an improved thermodynamic efficiency. The improved thermodynamic efficiency results in improved fuel efficiency.

Typically, a variable displacement engine will have a very small set of available operational modes. For example, some commercially available 8 cylinder variable displacement engine are capable of operating in a 4 cylinder mode in which only four cylinders are used, while the other four cylinders are deactivated (a ⅝ variable displacement engine). Another commercially available variable displacement engine is a 3/4/6 engine which is a six cylinder engine that can be operated with either 3, 4, or 6 active cylinders. Of course, over the years, a variety of other fixed cylinder set variable displacement engines have been proposed as well, with some suggesting the flexibility of operating with any number of the cylinders. For example, a 4 cylinder engine might be operable in 1, 2, 3, or 4 cylinder modes.

Another engine control approach that varies the effective displacement of an engine is referred to as "skip fire" engine control. In general, skip fire engine control contemplates selectively skipping the firing of certain cylinders during selected firing opportunities. Thus, a particular cylinder may be fired during one firing opportunity and then may be skipped during the next firing opportunity and then selectively skipped or fired during the next. In this manner, even finer control of the effective engine displacement is possible. For example, firing every third cylinder in a 4 cylinder engine would provide an effective displacement of ⅓$^{rd}$ of the full engine displacement, which is a fractional displacement that is not obtainable by simply deactivating a set of cylinders.

In general, skip fire engine control is understood to offer a number of potential advantages, including the potential of significantly improved fuel economy in many applications. Although the concept of skip fire engine control has been around for many years, and its benefits are understood, skip fire engine control has not yet achieved significant commercial success in part due to the challenges it presents. In many applications such as automotive applications, one of the most significant challenges presented by skip fire engine operation relate to NVH (noise, vibration & harshness) issues. In general, a stereotype associated with skip fire engine control is that skip fire operation of an engine will make the engine run significantly rougher than conventional operation.

Co-assigned U.S. Pat. Nos. 7,577,511, 7,849,835, 7,886,715, 7,954,474, 8,099,224, 8,131,445, 8,131,447, 8,336,521 and other co-assigned patent applications describe a new class of engine controllers that make it practical to operate a wide variety of internal combustion engines in a skip fire operational mode. Although the described controllers work well, there are continuing efforts to further improve the technology and/or to provide alternative approaches to implementing such control. The present application describes a variety of arrangements that can be used to control the firings in a skip fire operational mode.

SUMMARY

A variety of skip fire engine controllers and control methods are described that utilize look-up tables, state machines, or other data structures to determine the timing or ordering of skip-fire firings. In one aspect, a skip fire engine controller utilizes a look-up table to determine when firings are appropriate to deliver a desired engine output. In some embodiments, a firing timing controller tracks a value indicative of the portion of a firing that has been requested, but not yet commanded and such information is utilized in the determination of the timing of the firings. The tracking of the portion of a firing that has been requested but not yet commanded may be accomplished in a wide variety of manners. By way of example, in some specific embodiments, the tracking is accomplished using an accumulator. In others the tracking may effectively be built into the look-up table itself. The accumulator value is particularly useful when transitioning between different requested firing fractions.

In another aspect, entries in the lookup table each include a first field that holds a value indicative of a fire/no fire (skip) decision. In some embodiments, each lookup table entry also includes a field indicative of an index or accumulator value which may be used when accessing the lookup table for the next firing event.

In another aspect, the skip fire engine controller may include a firing fraction determining unit arranged to determine a desired operating firing fraction and a firing timing controller arranged to direct firings in a skip fire manner that delivers the desired firing fraction. The firing timing controller is arranged to utilize a look-up table to determine when firing are appropriate. In some embodiments, the firing controller utilizes a current firing fraction request and an accumulator value as indices for the lookup table to facilitate making the next firing decision.

In some embodiments, multiple lookup tables may be provided such that different tables can be used in association with specific power train operating parameters. By way of example, separate tables can be provided for use in conjunction with different transmission gears, selected engine speed ranges, etc. Such functionality may be provided by using multiple discrete lookup tables or lookup tables having extra dimensions.

A variety of methods of determining the sequence of firings for skip fire control are also provided.

In still another aspect, a skip fire engine controller is provided that utilizes a state machine to determine when firing are appropriate to deliver the desired engine output. In some such embodiments, transitions between states in the state machine are based at least in part on at least one of: (i) a value indicative of a portion of a firing that has been requested but not yet delivered; and (ii) a requested firing fraction.

BRIEF DESCRIPTION OF THE DRAWINGS

The invention and the advantages thereof, may best be understood by reference to the following description taken in conjunction with the accompanying drawings in which:

FIG. 4 is a representation of an alternative table based data structure suitable for use in determining the sequence of firings in accordance with another described embodiment.

In the drawings, like reference numerals are sometimes used to designate like structural elements. It should also be appreciated that the depictions in the figures are diagrammatic and not to scale.

DETAILED DESCRIPTION

The present invention relates generally to methods, data structures and control mechanism for determining the sequence/timing of skip-fire firing. In various embodiments, various look-up tables, data structures, state machines and controllers are described that are suitable for use in skip-fire engine control.

Figure 1:
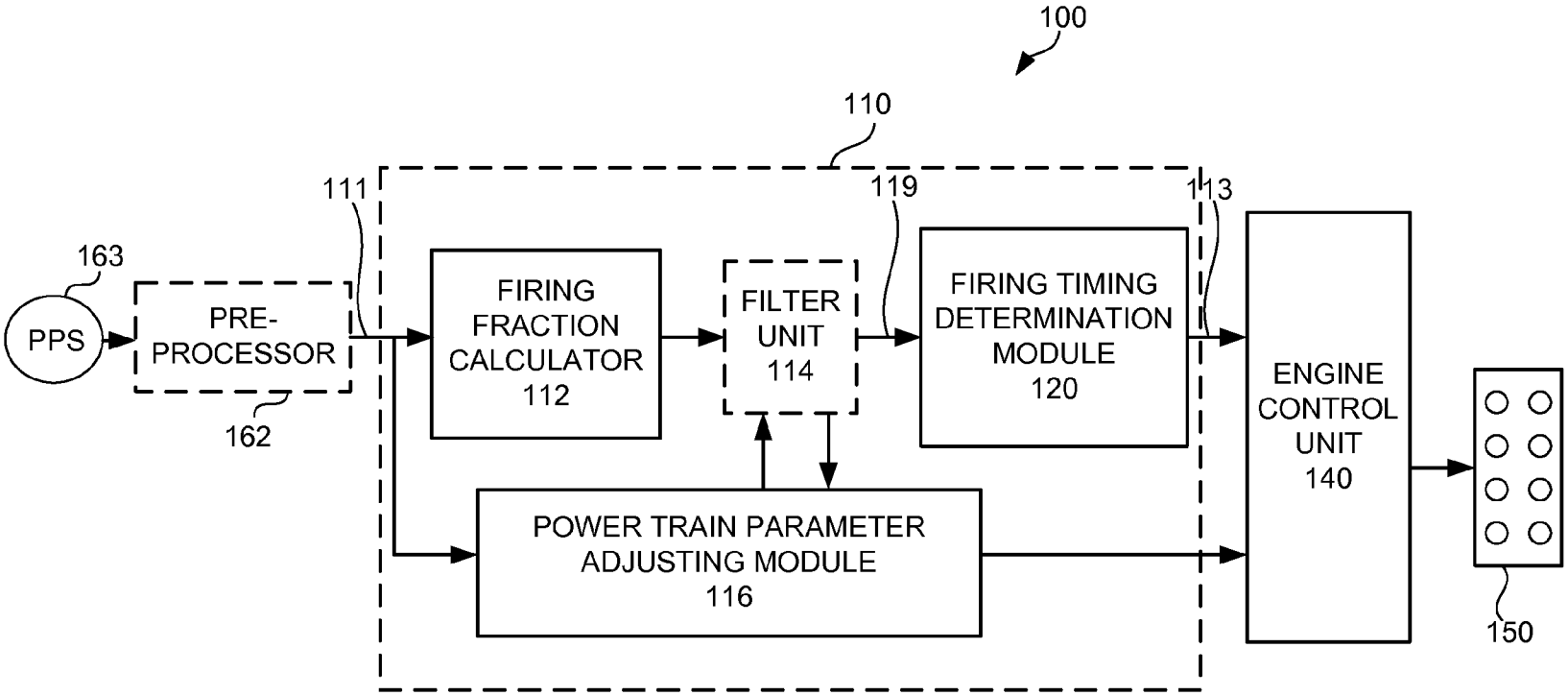
FIG. 1 is a block diagram of an exemplary skip fire engine controller that can make use of firing timing control in accordance with various embodiments of the present invention.

Referring initially to FIG. 1, a skip fire engine controller that incorporates a firing timing determining unit in accordance with one embodiment of the present invention will be described. The engine controller 100 includes a skip fire controller 110 arranged to work in conjunction with an engine control unit (ECU) 140. In other embodiments, the functionality of the skip fire controller 110 may be incorporated into the ECU 140. The illustrated skip fire controller 100 includes a firing fraction calculator 112, a filter unit 114, a power train parameter adjusting module 116, and a firing timing determining module 120. The skip fire controller receives an input signal 111 indicative of a desired engine output and is arranged to generate a sequence of firing commands that cause an engine 150 to provide the desired output using a skip fire approach.

In the embodiment of FIG. 1, the input signal 111 is treated as a request for a desired engine output. The signal 111 may be received or derived from an accelerator pedal position sensor (PPS or APP) or other suitable sources, such as a cruise controller, etc. In FIG. 1 an optional preprocessor 168 may modify the accelerator pedal signal prior to delivery to the skip fire controller 110. However, it should be appreciated that in other implementations, the accelerator pedal position sensor 165 may communicate directly with the skip fire controller 110.

The firing fraction calculator 112 receives input signal 111 and is arranged to determine a skip fire firing fraction that would be appropriate to deliver the desired output under selected engine operating conditions. The firing fraction is indicative of the percentage of firings under the current (or directed) operating conditions that are required to deliver the desired output. In some preferred embodiments, the firing fraction may be determined based on the percentage of optimized firings that are required to deliver the driver requested engine torque (e.g., when the cylinders are firing at an operating point substantially optimize for fuel efficiency). However, in other instances, different level reference firings, firings optimized for factors other than fuel efficiency, the current engine settings, etc. may be used in determining the appropriate firing fraction.

In the illustrated embodiment, an optional power train parameter adjusting module 116 is provided that cooperates with the firing fraction calculator 112. The power train parameter adjusting module 116 directs the ECU 140 to set selected power train parameters appropriately to insure that the actual engine output substantially equals the requested engine output at the commanded firing fraction. By way of example, the power train parameter adjusting module 116 may be responsible for determining the desired mass air charge (MAC) and/or other engine settings that are desirable to help ensure that the actual engine output matches the requested engine output. Of course, in other embodiments, the power train parameter adjusting module 116 may be arranged to directly control various engine settings.

The firing timing determining module 120 is arranged to issue a sequence of firing commands (e.g., drive pulse signal 113) that cause the engine to deliver the percentage of firings dictated by a commanded firing fraction 119. As will be described in more detail below, the firing timing determining module 120 may take a wide variety of different forms. For example, in some of the described embodiments, the firing timing determining module 120 utilizes various types of lookup tables to implement the desired control algorithms. The sequence of firing commands (sometimes referred to as a drive pulse signal 113) outputted by the firing timing determining module 120 may be passed to an engine control unit (ECU) or combustion controller 140 which orchestrates the actual firings.

In the embodiment illustrated in FIG. 1, the output of the firing fraction calculator 112 is optionally passed through a filter unit 114 before it is delivered to the firing timing determining module 120. The filter unit 114 is arranged to mitigate the effect of any step change in the commanded firing fraction such that the change in firing fraction is spread over a longer period. This "spreading" or delay can help smooth transitions between different commanded firing fractions and can also be used to help compensate for mechanical delays in changing the engine parameters.

In particular the filter unit 114 may include a first filter that smoothes the abrupt transition between different commanded firing fractions to provide better response to engine behavior and so avoid a jerky transient response. In some circumstances, a change in the commanded firing fraction and/or other factors will cause the power train adjusting module 116 to direct a corresponding change in the engine (or other power train) settings (e.g., throttle position which may be used to control manifold pressure/mass air charge). To the extent that the response time of the first filter is different than the response time(s) for implementing changes in the directed engine setting, there can be a mismatch between the requested engine output and the delivered engine output. Indeed, in practice, the mechanical response time associated with implementing such changes is much slower than the clock rate of the firing control unit. For example, a commanded change in manifold pressure may involve changing the throttle position which has an associated mechanical time delay. Once the throttle has moved there is a further time delay to achieve of the desired manifold pressure. The net result is that it is often not possible to implement a commanded change in certain engine settings in the timeframe of a single firing opportunity. If unaccounted for, these delays would result in a difference between the requested and delivered engine outputs. The filter unit 114 may also include a second filter (not shown) to help reduce such discrepancies. More specifically, the second filter may be scaled so its output changes at a similar rate to the engine behavior; for example, it may substantially match the intake manifold filling/unfilling dynamics. The filters within the filter unit 114 may be constructed in a wide variety of different manners.

The firing fraction calculator 112, the filter unit 114, and the power train parameter adjusting module 116 may take a wide variety of different forms and their functionalities may alternatively be incorporated into an ECU, or provided by other more integrated components, by groups of subcomponents or using a wide variety of alternative approaches. By way of example, some suitable firing fraction calculators, filter units, and the power train parameter adjusting modules are described in co-assigned patent application No. 61/640,646, which is incorporated herein by reference, although these functionalities may be provided in numerous other ways as well. In various alternative implementations, these functional blocks may be accomplished algorithmically using a microprocessor, ECU or other computation device, using analog or digital components, using programmable logic, using combinations of the foregoing and/or in any other suitable manner.

Firing Timing Determining Module

The incorporated co-assigned patents and patent applications describe a variety of different mechanism that can be used to determine the timing/sequence of the firings. Many of the described embodiments contemplate the use of sigma-delta conversion to dictate the sequence of the firings. By way of example, one suitable approach that facilitates explanation contemplates the use a first order sigma delta (FOSD) converter. Such a converter tends to spread the firing as evenly as possible even through changes in the requested firing fraction, which tends to mitigate the generation of undesirable engine vibrations.

Table 1 below will be used to facilitate an explanation of first order sigma delta computation. In general, each time a firing opportunity arises, the first order sigma delta converter (sometimes referred to as a drive pulse generator) adds the currently requested firing fraction to an accumulated carryover value from the previous cylinder operation. In essence, the accumulated carryover value is indicative of a portion of a firing that has been requested, but not yet directed (commanded). If the sum is less than 1, the corresponding cylinder is not fired and the sum is carried over to be used in the determination of the next firing. If the sum exceeds 1, the cylinder is fired and the value of 1 is subtracted from the accumulated value. The process is then repeated for each firing opportunity. The table below, which is believed to be self-explanatory, illustrates a firing sequence generated in response to a particular firing fraction input sequence.

TABLE 1

| Cylinder No. | Requested Firing Fraction | Accumulated Value Carryover | Sum | Fire? |
|---|---|---|---|---|
| 1 | .35 | 0 | .35 | No |
| 2 | .36 | .35 | .71 | No |
| 3 | .36 | .71 | 1.07 | Yes |
| 4 | .36 | .07 | .43 | No |
| 5 | .39 | .43 | .82 | No |
| 6 | .41 | .82 | 1.23 | Yes |
| 1 | .45 | .23 | .68 | No |
| 2 | .45 | .68 | 1.13 | Yes |
| 3 | .45 | .13 | .58 | No |
| 4 | .45 | .58 | 1.03 | Yes |
| 5 | .45 | .03 | .48 | No |
| 6 | .45 | .48 | .93 | No |

As described in some of the incorporated patents/patent applications, first order sigma delta (FOSD) computation can be accomplished using software, firmware, digital hardware, analog hardware or a combination of the above. In the present application, controllers are described that utilize look-up tables, finite state machines, and/or predefined patterns with indexing to provide FOSD functionality.

To facilitate an understanding of how such mechanisms work, there are some characteristics of first order sigma delta conversion that are worth noting. Initially, it should be appreciated that for a fixed (steady state) input firing fraction an idealized first order sigma-delta converter will yield a constant, repeating firing pattern. These steady-state firing patterns will vary in length depending on the firing fraction denominator. For example, a firing fraction of ½ will repeat every 2 firing opportunities, a firing fraction of 7/15 will repeat every 15 firing opportunities and a firing fraction of 33/100 will repeat every 100 firing opportunities. Theoretically, if the firing fraction were an irrational number, the firing pattern would never repeat. However, in a practical digital control implementation, the maximum firing pattern length is generally set by the firing fraction bit resolution.

When skip fire control is used as one of the primary mechanisms for modulating a vehicle's engine output, the firing fraction is potentially continually changing due to varying driving requirements. A major advantage of sigma delta type of engine control in general relates to transition management in situations where the engine switches between different firing fractions. The accumulator functionality of the sigma delta tends to spread the firing as evenly as possible even through changes in the requested firing fraction, which tends to mitigate the generation of undesirable engine vibrations. As a result of the accumulator functionality, the resultant firing sequence is, in general, not constrained to any fixed pattern.

Look-Up Table Based Firing Timing

The functionality of a digital first order sigma delta (FOSD) converter can readily be implemented using a variety of different look-up tables and look-up table based methods. In general, an output similar to or equal to that of a quantized FOSD can be obtained by appropriately constructing a lookup table and defining selection rules to move about the table. By way of example, in some implementations, the rows of the table may be arranged to correspond to the input firing fraction and the columns of the table may be arranged to correspond to the integrator (accumulator) value in a FOSD. In such an arrangement, the number of rows effectively dictates the quantization of the input. For example 128 rows could be equivalent to a 7-bit firing fraction quantization, or 256 rows could be used to represent an 8-bit firing fraction quantization. Of course, higher or lower quantization levels can readily be used in various implementations and there is no need for the quantization to be a power of 2, although using a quantization level that is a power of 2 has some potential advantages with respect to the design simplicity. As will be explained further below, in many implementations not all firing fractions may be permitted so the number of available rows may be varied as well at any given quantization level. Furthermore, there is no need for the quantization level to be constant over the entire range of inputs.

Figure 2:
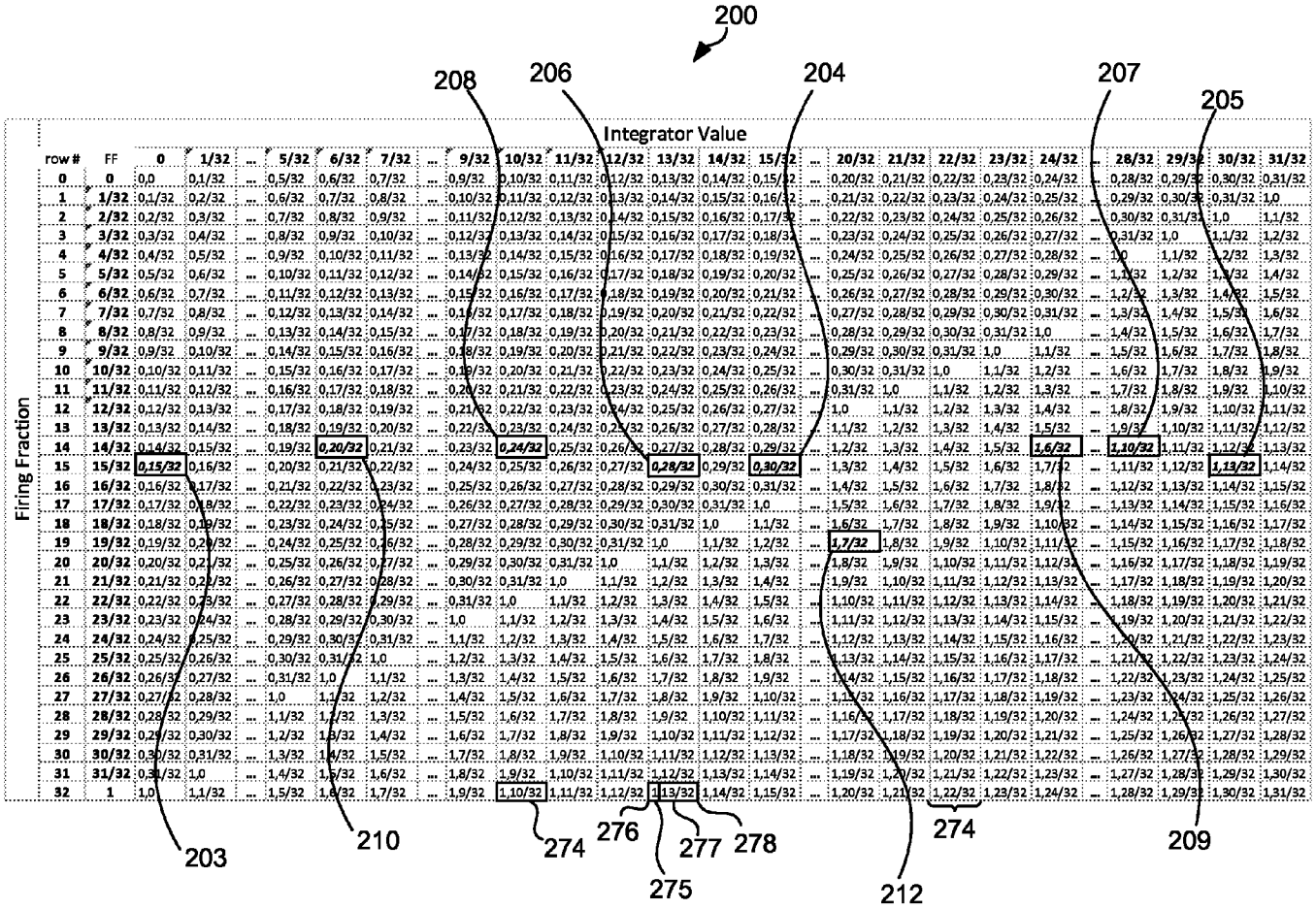
FIG. 2 is a representation of a table data structure suitable for use in determining the sequence of skip-fire firings in accordance with one described embodiment of the present invention.

Referring next to FIG. 2, one representative lookup table structure will be described. In the illustrated embodiment, the entries 274 of the table 200 contain two pieces of information (e.g., two fields) as an ordered number pair. One number in the number pair may correspond to a firing decision. For example, a "1" may indicate that the cylinder should be fired and a "0" may indicate that the cylinder should not be fired, i.e. the firing should be skipped. The other number in the ordered pair may be an index or integrator value, which provides a "memory" of recent firing decisions. The index may serve a function similar to the accumulator or integrator of a sigma-delta modulator. As such, the index or integrator value may be arranged to define the column to be read when the next firing decision is made. Thus, when the next firing decision is to be made, the new input firing fraction dictates the row, and the current index entry dictates the column. Stated another way, a first field 275 in each entry 274 includes a firing indicator 276 indicative of whether or not to fire a selected working chamber and a second field 277 in each entry includes an accumulator indicator 278 indicative of the new accumulator value associated with the entry 274.

In the embodiment of FIG. 2, look-up table 200 has 33 rows and 32 columns, with each row corresponding to an input firing fraction and each column corresponding to a resultant accumulator value. The entries 274 in FIG. 2 were selected such that the control implemented by traversing the table in the described manner provides a skip-fire control response that is identical to the control achieved by a 5-bit digitally implemented FOSD for any sequence of input firing fractions.

For the purposes of illustration, consider, for example, a scenario where the initial firing fraction is 15/32. In this scenario, row 15, column zero (labeled box 203) is read for the first firing opportunity (because the firing fraction 15/32 dictates the row, and the current accumulator value—which would be zero initially, indicates the column). The associated value pair is "0", "15/32" indicating no fire and a new accumulator value of "15/32". At the second firing opportunity, with the firing fraction remaining at 15/32, row 15, column 15 (labeled box 204) is read indicating that this second firing opportunity is skipped and a new accumulator value of "30/32". At the third firing opportunity, with the firing fraction again remaining at 15/32, row 15, column 30 (labeled box 205) is read indicating that the current cylinder is to be fired, with the accumulator value changing to "13/32." At the fourth firing opportunity with the firing fraction remaining the same, row 15, column 13 (labeled box 206) would be read, which indicates another skip and a new accumulator value of "28/32". So long as the firing fraction remains the same, the firings would be dictated by sequentially reading appropriate values from row 15 in this cyclic manner.

Of course, in practice, the desired firing fraction will periodically change and depending on the controller design and the nature of the driver demand, such changes may range anywhere from relatively infrequent changes to substantially continuous changes. Accordingly, consider a scenario where at the time of the $5^{th}$ firing opportunity, the firing fraction changes to 14/32. In this event row 14, column 28 would be read (labeled box 207) because the new firing fraction 14/32 dictates the use of a new row while the accumulator value (now 28/32) is still used to determine the column. This entry indicates that the associated working chamber is to be fired and the new accumulator value is "10/32". Utilizing the table in the same manner, with the firing fraction remaining at 14/32, the next few firing opportunities would be dictated by row 14, columns 10, 24 and 6 and (boxes labeled 208-210 respectively) etc. If the firing fraction then changed to 19/32, row 19, column 20 (labeled box 212) would be read (indicating an associated firing) and a new accumulator value of "7/32" and the process can be followed continually so that the engine delivers the desired output.

It should be apparent that with the described approach, a look-up table can be used to deliver any requested firing fraction in substantially the same manner as a digital sigma delta converter would provide. The size and quantization of the look-up table can be widely varied to meet the needs of any particular application. By way of example quantization levels on the order of 5 to 16 bits work well in many applications.

In the embodiment illustrated in FIG. 2, the firing decisions are dynamically made on a firing opportunity by firing opportunity (working cycle by working cycle) basis. That is, an independent determination regarding whether or not to fire is made for every firing opportunity based on current conditions. However, in other embodiments the table can readily be set up such that two or more firing decisions (e.g., the next two firing decisions, the next three firing decisions, the next eight firing decisions, etc.) are made at one time.

In the embodiment of FIG. 2, the look-up table is configured to mimic the output of a first order sigma delta converter. Although this type of approach works well, it should be appreciated that the look-up tables can be configured to provide any desired control. For example, in various alternative embodiments, a lookup table may be constructed using predefined patterns for each firing fraction without requiring that the firing patterns correspond to the sequence that would be generated using first order sigma delta. It should be appreciated that using different firing patterns may result in a situation in which the accumulator value is (i) one or more; or (ii) less than zero. In contrast, in the embodiment illustrated in FIG. 2, the accumulator value is never less than zero and is never greater than or equal to one. However, this is not a requirement and in other embodiments, using negative accumulator values and/or accumulator values greater than one may be useful to facilitate the delivery of a desired firing pattern or control response. This may be desirable, for example, to improve NVH (noise, vibration and harshness) characteristics at any particular firing fraction. By way of example, in some V-8 engines, a firing fraction of 1/3 has very good vibration characteristics but may induce some undesirable acoustic resonances. Such acoustic resonances can sometimes be mitigated substantially by slightly altering the firing pattern, which can readily be accomplished through the use of appropriately constructed lookup tables. Accumulator values outside the range of 0-1 can readily be accommodated by providing additional columns to the look-up table of FIG. 2.

In the embodiment illustrated in FIG. 2, the table is conceptually set up such that no firing is directed until an accumulated value of at least a full firing has been requested. That is, if the requested firing fraction is 8/32 (i.e., 1/4) with the accumulator initially being "0", the controller will not direct a firing until the fourth firing opportunity (i.e., there will be three skips before the first fire). As such, the accumulator value indicates that portion of a firing that has been directed, but not yet delivered. In other embodiments, the table could conceptually be set up in an opposite manner in which a firing is initially directed and the accumulator value indicates the portion of a firing that has been delivered in "excess" of what has been requested. In such an arrangement, if the requested firing fraction is 8/32 (i.e., 1/4) with the accumulator initially being "0", the controller will direct a firing on the first firing opportunity, followed by three skips.

It should be appreciated that the ability to precisely dictate the firing order using the described lookup table approach allows certain firing sequences (e.g., firing sequences having specific NVH characteristics) to be used that would be challenging to implement using digital or analog sigma delta conversion.

In the embodiment illustrated in FIG. 2, rows are provided for firing fractions of both "0" and "1". A firing fraction of "0" suggests that none of the cylinders are being fired, and a firing fraction of "1" suggests that all of the cylinders are being fired as occurs during "conventional", non-skip fire operation. These are both special cases that are not really in the realm of skip fire control and in many control implementations, they would be handled outside of skip fire control. However, if desired, they could be handled using the same table based approach, which facilitates easy transitions in and out of skip-fire control modes.

The embodiment illustrated in FIG. 2 also includes rows for each firing fraction within the quantization level. However, in some embodiments, certain firing fractions may not be permitted for specific reasons. In such embodiment, the associated firing fraction rows may optionally be excluded. There are several control reasons why it may be desirable to avoid the use of selected specific firing fractions. For example, some firing fractions may be undesirable from a NVH standpoint and are therefore excluded for that reason. Also, in some implementations it may be desirable to require a minimum firing fraction—which can lead to the elimination of some of the rows associated with the lower firing fractions (e.g., in an implementation that has a minimum firing fraction of 5/32, rows 0-4 can be eliminated). Sometimes it is desirable to utilize a maximum firing fraction for skip fire control and in such implementations, one or more of the corresponding rows of the higher firing fractions may be eliminated. This may be appropriate in situations where "normal", all cylinder operation is elected any time that the requested output (and the associated firing fraction) exceeds a designated threshold (e.g. 29/32).

Figure 3:
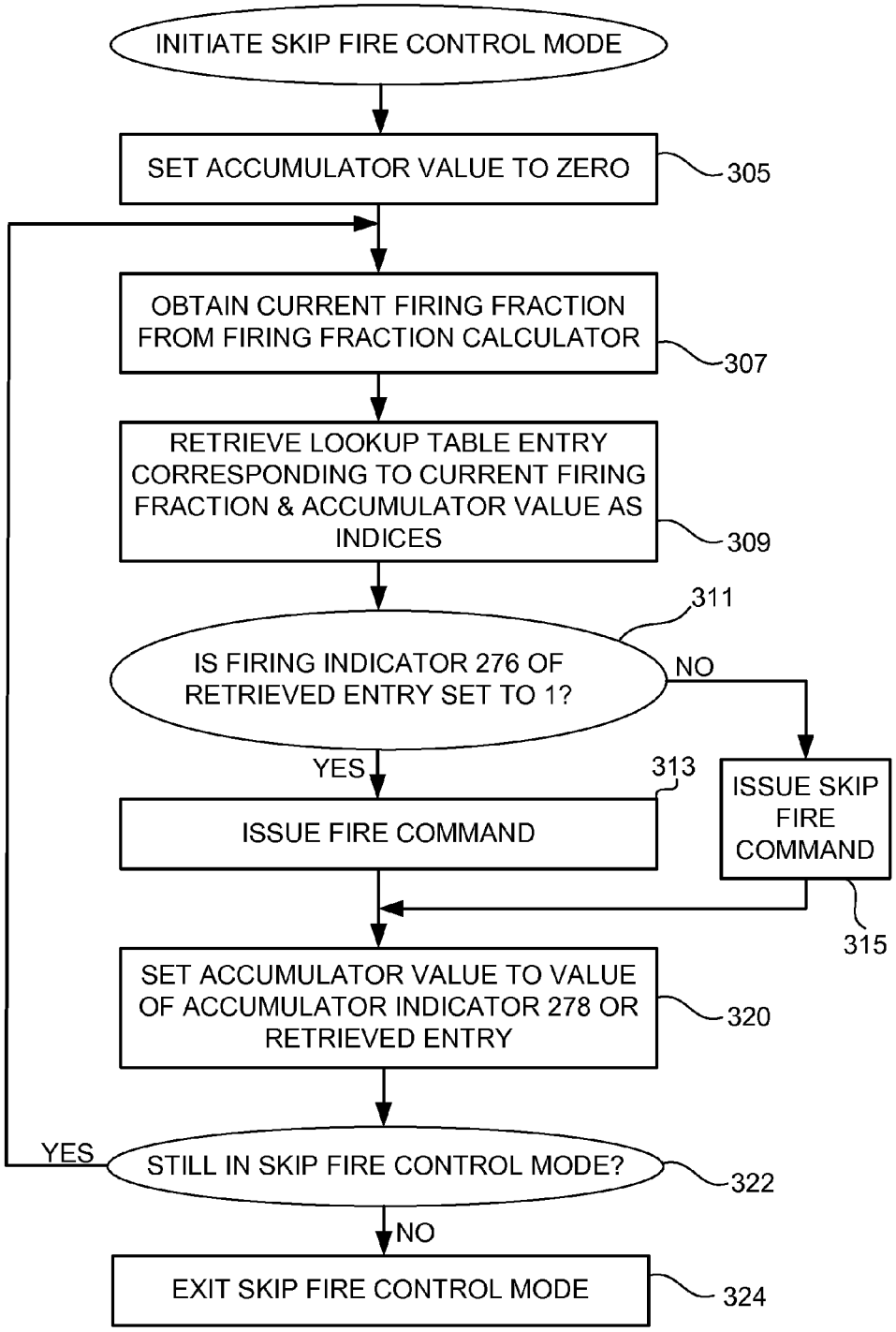
FIG. 3 is a flow chart illustrating a method of determining the sequence of firings utilizing look-up tables such as the table illustrated in FIG. 2.

It should be appreciated that a number of different control algorithms and a variety of different controller logic can be arranged to utilize the described table in a manner suitable for delivering the desired skip fire control. By way of example, one simple control algorithm suitable for traversing the look-up table of FIG. 2 in a manner suitable for delivering the requested firing fraction will be described with respect to FIG. 3. In this illustrated embodiment, when skip fire control is initiated, the accumulator value is set to an initial value in step 305. Typically, the initial accumulator value will be zero, although in specific embodiments, it may be desirable to initialize the accumulator with a non-zero value. Thereafter, in step 307, the current firing fraction is received from the firing fraction calculator or other suitable source. In step 309, the lookup table is accessed using the firing fraction and the current accumulator value as indices to retrieve the table entry corresponding to the current firing fraction and accumulator value. The firing indicator 276 is then read from the retrieved entry and if the retrieved firing indicator 276 is a firing command (e.g., a "1" in the embodiment of FIG. 2) a firing command is issued in step 313. Alternatively, if the firing indicator 276 is a skip firing command (e.g., a "0" in the embodiment of FIG. 2), a skip firing command is issued in step 315. Regardless of whether a firing command, or a skip fire command is illustrated, the accumulator is set to the value of the accumulator indicator 278 of the retrieved entry in step 320. A determination is then made regarding whether the engine is still in a skip fire control mode (step 322) and if so, the logic returns to step 307 where the current firing fraction is retrieved and the process continues in the same manner as long as the engine control remains in the skip fire control mode. Although a particular control algorithm has been described, it will be apparent that the order of many of the steps can be altered and a variety of other algorithm can be used to deliver the desired results.

Referring next to FIG. 4, another suitable data structure and corresponding indexing based control algorithm will be described that contemplates the use of predefined patterns. In this illustrated embodiment, each row 402 in data structure 400 again corresponds to a designated firing fraction. Each entry 474 again includes a first field 475 that indicates a fire/no fire decision and a second field 477 that indicates an associated accumulator value. In this embodiment, a selected row in the table is read sequentially for successive firing opportunities at the same firing fraction and the accumulator value is only utilized when transitioning between different firing fractions. Thus, for example, if the initial firing fraction is 7/16 and the initial accumulator value is zero, then the controller would initially read the second entry in row 12 (labeled box 403) followed by the third, fourth, fifth, sixth etc. entries in row 12 (labeled boxes 404-407 respectively) to determine whether firings are appropriate for sequential firing opportunities. As can readily be seen in FIG. 4, in this particular embodiment, the $1^{st}$, $2^{nd}$, $4^{th}$, $6^{th}$, etc. firing opportunities would be skipped while the $3^{rd}$, $5^{th}$, $7^{th}$ etc. firing opportunities would be fired. Once the end of the row is reached, the logic would return to the first entry in row 12 (box 409) and this cycle continues as long as the requested firing fraction remains the same. It should be appreciated that such traversal of a data structure can readily be accomplished by the use of an indexing pointer or using a wide variety of other conventional mechanism.

When a change in firing fraction is requested, the index (accumulator value) is used to determine which entry to begin with upon transitioning to the next firing fraction. To illustrate this transition, consider a scenario in which a transition to a new firing fraction of 9/16 is commanded after a firing decision associated with the entry labeled 407 in FIG. 4 is made. In this case, the index (accumulator value) 474 associated with entry 407 is 3. Thus, the next firing decision is determined based on the entry in row 21 that follows the entry associated with an index value of 3 (i.e., the box labeled 411). From that point, the firing decisions continue sequentially through row 21 so long as the firing fraction remains at 9/16. Again, each time the end of the row is reached, the logic would wrap around to the first entry in row 21. The next time that the firing fraction changes, the appropriate row is accessed using the index associated with the previous firing decision to determine the appropriate entry point for the associated row.

It should be appreciated that when accessing a new row for the first time, the first entry read is the entry that follows the entry with the matching accumulator value. This insures that smooth transitions occur without loss of accumulator values. Thus, for example, when initially entering the skip fire control mode with an accumulator value of zero, the first entry that is read is the entry that follows the associated firing fraction entry with an accumulator value of zero. In the illustrated embodiment, each of the entries corresponding with a particular firing fraction has a unique accumulator value.

There are a couple noteworthy differences between the table in FIG. 2 and the data structure in FIG. 4. The first difference is that in the embodiment of FIG. 4, for a fixed firing fraction, the resulting pattern is read by sequentially moving one entry to the right in the appropriate row for each firing decision. Upon reaching the rightmost entry in any particular row, the pattern continues starting at the leftmost entry. The second difference is that some firing patterns are duplicates, but have different indexing information. The duplicates result because some firing sequences repeat more rapidly than others. For example, a firing fraction of ½ will generate a sequence that repeats every two firing opportunities, while a firing fraction of 7/16 will repeat every 16 firing opportunities. Duplicates can be thought of as patterns having an identical waveform, but displaced in phase from each other. This phase won't manifest itself until the firing fraction changes, when it can affect the timing of the next skip or fire.

When a transition is made between firing fractions, the row or rows corresponding to the new firing fraction are scanned until the accumulator value associated with the last firing opportunity is found. The following entry is then read to dictate the firing decision for the next firing opportunity. If the new firing fraction has several different associated rows, then more than one (and possibly all) of the rows associated with the new firing fraction may need to be scanned to find the entry with the appropriate index value. In some embodiments, the scanning can be simplified by providing an accumulator index (not shown) for each firing fraction that points to the appropriate entry within row/set of rows for each possible accumulator value.

For simplicity, in the illustrated embodiment, the rows are constructed in a manner that they do not repeat and would give the same result as a similarly quantized first order sigma delta and thus, given the low (4-bit) quantization, the rows are relatively short. However, it should be appreciated that the rows can readily be constructed to be much longer and could potentially repeat. By way of example, the data structure could be configured as a consistent length rows if desired which has some advantages in terms of implementation simplicity. For example, one possible consistent row length would be rows having a number of entries equal to the least common multiple of the available firing fractions. In such an embodiment, there might be two or more repetitions of the same sequence in a particular row. Furthermore, although the illustrated embodiment has just 4-bit quantization, it should be appreciated that in many embodiments, significantly more firing fractions would be provided. Additionally, although row lengths that are a power of two are used primarily in the examples given herein, row lengths of any size may be used and the available row lengths are in no way limited to values that are powers of two.

Furthermore, the rows can be constructed in a manner that generates slightly different (or significantly different) patterns than first order sigma delta would generate for a given firing fraction. Like the previously described embodiment, this may require appropriate handling of accumulator values of below zero or of one or more. However, it gives a great deal of flexibility in defining specific firing patterns that are known to have good NVH characteristics.

In the various embodiments described above, the accumulator is arranged to accurately track the portion of a firing that has been requested but not yet delivered. Thus, for example, if the accumulator value associated with a particular entry is zero and the firing fraction is 0.35, then the accumulator value associated with the next entry would be 0.35. However, that is not a strict requirement. Thus, when desired for control reasons, it is possible to construct the table entries in a manner where the actual increase between sequential entries is less than or greater than the actual firing fraction. For example, rather than the accumulator value associated with the next entry being 0.35 in the example given above, it could be rounded value (such as ⅓ or 11/32) or a number that is higher or lower (typically slightly higher or lower e.g. 0.36 or 0.34) than would attained by perfect accumulator.

In some implementations it may be desirable to utilize different firing sequences based on selected power train parameters such as engine RPM, transmission gear ratio etc. This can readily be accomplished by using multiple look-up tables. Alternatively, multi-dimensional look-up tables can be used to provide the same functionality, with one of the dimensions being a power train parameter of interest such as the transmission gear currently in use. By way of example, since NVH characteristics tend to vary significantly between different transmission gears, in some implementations it will be desirable to provide separate firing look-up tables for each gear. Similarly, factors such as engine speed may have a significant impact on the number of desired firing fractions—thus, in some embodiments it may be desirable to provide separate firing look-up tables for different designated engine speed ranges (or other selected engine characteristics). The lookup tables may have multiple additional dimensions (as for example both gear and engine speed) and/or may be constructed in any way appropriate for use in a particular engine.

An advantage of using the various described look-up table based approaches to the firing timing decision making is that the table designer has wide flexibility in defining a set of permissible firing patterns. Such deterministic control tends to be more difficult to implement using logic based approaches when the desired patterns are not susceptible to simple algorithmic definition.

The lookup table based control methods employ a defined set of rules to move between various lookup table entries and/or between different lookup tables. As will be apparent to those familiar with the art, the specifics of the table traversing algorithms may be widely varied to meet the needs of any particular application and will also vary with the specific table or other data structure utilized.

In the embodiments discussed above, only the sequence of the firings is dictated by the tables. However, in some implementations it may be desirable to dictate (or cause the adjustment of) other engine parameters as well. By way of example, there may be times when it is desirable to define a firing pattern for a particular requested firing fraction that actually provides a slightly different fraction of firings than the requested firing fraction. In such situations, the net output of the engine would be different than the requested output which is generally undesirable. However, these differences can often be accounted for by appropriately altering other engine parameters such as manifold absolute pressure (MAP) or mass air charge (MAC). The table can readily be arranged to store information indicative of a factor (or factors) that are appropriate to alter in order to provide the desired engine output. For example, if a requested firing fraction is 0.39, but it is determined that it is better to use a firing pattern that actually fires 40% of the firings, then it may be desirable to adjust other engine parameters when that firing fraction is in use so that that the output generated by each firings is scaled down by 2.5% (39/40). Such a scaling factor can be provided as an additional column associated with the table or in any other suitable data structure or manner. The actual scaling can then be handled in a conventional manner by the ECU 140, the power train parameter adjusting module 116 or by any other suitable mechanism. In this manner, appropriate changes in the overall engine output can be included in the look up table on a row by row basis. Of course, in still other embodiments, relative or fixed adjustments or scaling of specific power train parameters (such as the MAP, the MAC etc.) may be defined in the table. One such example is provided in Provisional Application No. 61/639,500 which is incorporated herein by reference.

It is also possible to modify the look up table approach to implement sigma-delta convertors higher than first order. A second order sigma-delta convertor has a second integrator, and this value can be incorporated by adding another dimension to the look up table, making each table entry an ordered number triple. Multi-dimensional lookup tables of arbitrary dimensions can be used and are well known in the art. Alternatively, the two integrator values can be concatenated to provide a single column index.

Finite State Machine Based Implementation

In another embodiment, a finite state machine (FSM) may be used in place of the look up tables. A finite state machine is a well-known computer programming tool defined by a set of states and transitions between those states. Given the present state and the input, the transitions determine the next state and the output of the FSM. In one representative finite state machine (FSM) implementation that mimics the results of a first order sigma delta modulator, the states of the state machine may be the discrete values of the accumulator/integrator. The transitions from state to state may be defined by the firing fraction and the output of the state machine may be the firing decision.

Figure 5:
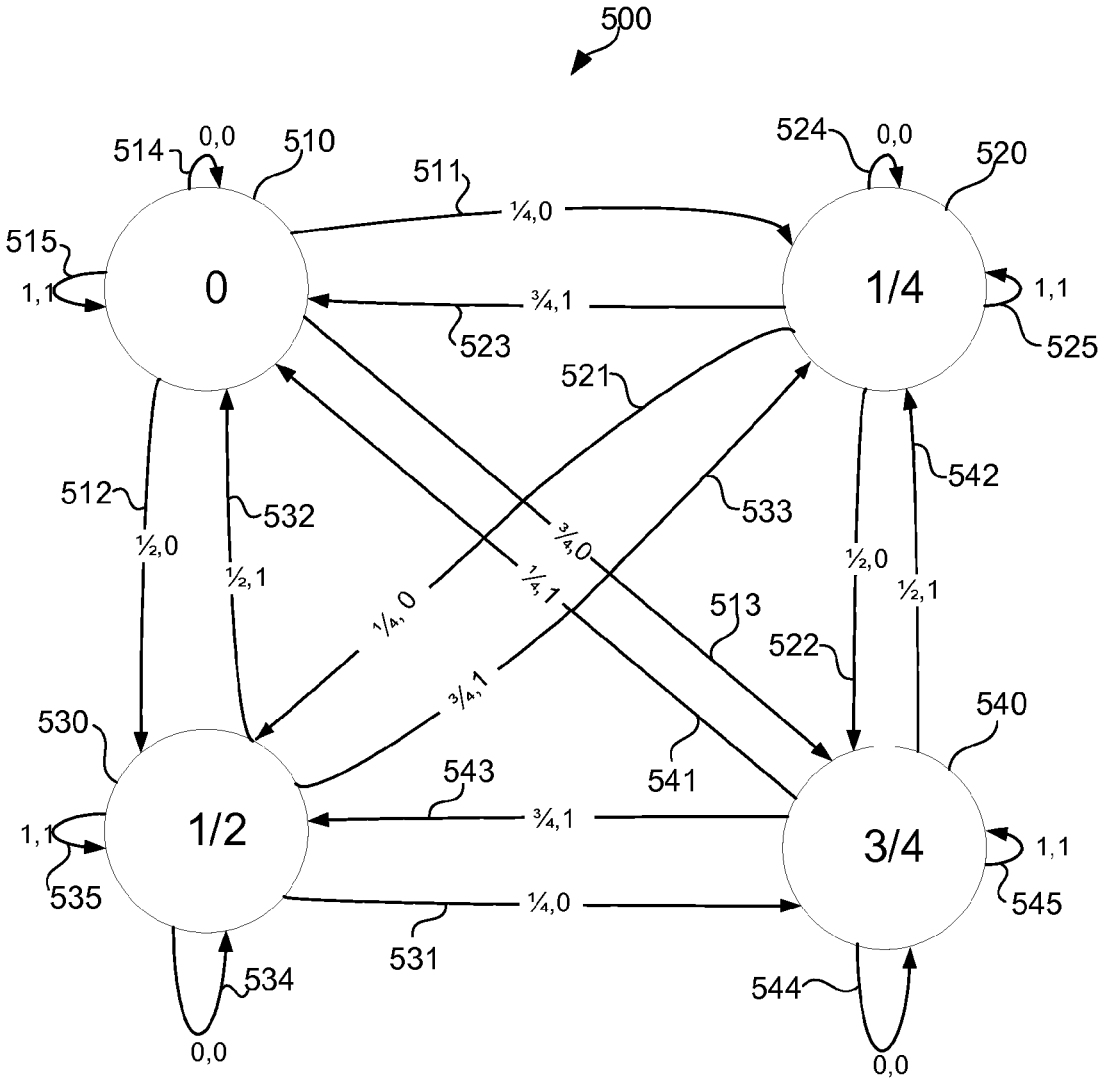
FIG. 5 is a state diagram illustrating a simplified state machine that may be used to determine the sequence of skip-fire firings in accordance with another embodiment of the present invention.

The construction of such an implementation is straightforward based on the previously described methods. FIG. 5 illustrates a very simplified state machine 500 having just 4 states (0, ¼, ½, and ¾, respectively labeled states 510, 520, 530 and 540). FIG. 5 is simplified to facilitate this explanation and it should be appreciated that an actual implementation would have many more states. In the illustrated embodiment, the circles represent the states, the connecting lines and arcs are the transitions. Each transition is labeled with an ordered pair: the first element is the input firing fraction; the second element is the output firing decision.

To see the FSM in operation, consider an initial input firing fraction of ¼. Initially, the accumulator value would be zero and the state machine would therefore begin in the state "0" labeled 510. With the initial firing fraction being ¼, the state would transition to state 520 conceptually following the path marked 511 and output for this first firing decision would be a "0", or skip. The labeling for path 511 is "¼, 0", with the first entry ¼ representing the current firing fraction and the second entry "0" representing the output of the state machine, in this case a "0", or skip. With the firing fraction remaining at ¼ over the next several firing opportunities, the state machine would sequentially transition:

(i) from state 520 (¼) to state 530 (½) outputting a "0" (skip command), following path 521;

(ii) from state 530 (½) to state 540 (¾) outputting a "0" (skip command), following path 531;

(iii) from state 540 (¾) to state 510 (0) outputting a "1" (fire command), following path 541;

(iv) from state 510 (0) to state 520 (¼) outputting a "0" (skip command), following path 511;

(v) from state 520 (¼) to state 530 (½) outputting a "0" (skip command), following path 521;

(vi) from state 530 (½) to state 540 (¾) outputting a "0" (skip command), following path 531;

(vii) from state 540 (¾) to state 510 (0) outputting a "1" (fire command), following path 541.

This repeating sequence would continue until a change in the firing fraction occurs. Any time the firing fraction changes, the transition path from the current state would change to follow the path associated with the new firing fraction. For example, if the firing fraction changed to "½" while the state machine is in state 520 (i.e., ¼), then the state machine would transition from state 520 (¼) to state 540 (¾) outputting a "0", following path 522. With the firing fraction remaining at ½ over the next several firing opportunities, the state machine would sequentially transition:

(i) from state 540 (¾) back to state 520 (¼) outputting a "1" (fire command), following path 542;

(ii) from state 520 (¼) to state 540 (¾) outputting a "0" (skip command), following path 522;

(iii) from state 540 (¾) to state 520 (¼) outputting a "1" (fire command), following path 542;

(iv) from state 520 (¼) to state 540 (¾) outputting a "0" (skip command), following path 522;

(v) from state 540 (¾) to state 520 (¼) outputting a "1" (fire command), following path 542 and so on.

As the firing fraction changes over time, the specific transition paths (e.g., 511-515, 521-525, 531-535, 541-545) followed at any time would depend on the inputted firing fraction as well as the then current state. In this way a state machine can be configured to provide a control that is equivalent to quantized first order sigma delta control.

Of course, practical implementations would contemplate many more states, but the construction would be similar. One useful approach would be to configure the state machine to provide a response equivalent to quantized first order sigma delta control as in the example provided above. Although such a design works well for control purposes, there is no inherent need to provide such control. Rather, the state machine can be configured to provide any type of control response desired by the designer.

Other Features

Although only a few embodiments of the invention have been described in detail, it should be appreciated that the invention may be implemented in many other forms without departing from the spirit or scope of the invention. For example, although a few particular skip-fire engine controllers that are suitable for utilizing the described firing timing determining modules have been describe, and others are described in some of the incorporated patents, it should be appreciated that the described firing timing control can be used with a wide variety of different skip-fire controllers and it is not limited to use with the described classes of skip fire controllers.

It should be appreciated that the described approach allows the skip fire controller to utilize a fairly wide range of firing fractions (as opposed to the fairly small sets contemplated by most conventional skip fire controllers or the extremely limited selection of displacements allowed in conventional variable displacement engines). The availability of a wide variety of firing fractions facilitates the attainment of better fuel efficiency than is possible in such conventional designs and improved NVH characteristics. In some implementations it is desirable to allow the number of available firing fractions to vary as a function of engine speed. This can readily be accomplished through the use of an appropriate firing fraction calculator and/or the use of different tables (or tables that include engine speed as an index).

In most of the embodiments described above, the firing tables, data structures and/or control algorithms are arranged to facilitate making an independent firing determination for each firing opportunity. However, this is not a requirement. Rather, the firing instructions for two or more (e.g., the next several) firing opportunities may be determined/defined at the same time. For example, when a look-up table is used, each entry may have the firing instructions (i.e., the firing sequence) for the next two, the next three, the next four, etc. firing opportunities and the accumulator value (or index, etc.) may be arranged to indicate the value that will be appropriate at the end of the defined sequence. Thus, for example, an entry might indicate that the next five firing opportunities are to be skip, fire, skip, skip, fire. Of course, the actual number of firing opportunities that are defined in each entry may be varied in accordance with the design goals of any particular implementation. In many such circumstances, the table/data structure/algorithm would be set up so that each entry defined the firing decisions associated with the same number of firing opportunities (e.g., 2, 4, 6, 8, etc.). However, that is not a requirement. For example, in still other implementations, the table/data structure/algorithm could be arranged to define the number of sequential skips until the next firing command—or conversely, the number of sequential fires until the next skip command. In still other embodiments, the table/data structure/algorithm could be arranged to define a repeating pattern that is to be used until the firing fraction is changes or some other interrupt is received. For example, if the commanded firing fraction is ⅓ and the next firing opportunity is expected to be a fire, the table/data structure/algorithm could be arranged to instruct the controller to implement a repeating pattern of a fire followed by two skips (e.g., fire, skip, skip, fire, skip, skip . . . ). In another example, if the accumulator value were appropriate with a commanded firing fraction of 40%, an entry could instruct a repeating pattern of a skip followed by a fire, then two more skips and another fire (e.g., skip, fire, skip, skip, fire, skip, fire, skip, skip, fire . . . ). Of course, the length of the commanded repeating patterns can be widely varied as well.

Although skip fire management is described, it should be appreciated that in actual implementations, skip fire control does not need to be used to the exclusion of other types of engine control. For example, there will often be operational conditions where it is desirable to operate the engine in a conventional (fire all cylinders) mode where the output of the engine is modulated primarily by the throttle position as opposed to the firing fraction. Additionally, or alternatively, when a commanded firing fraction is coextensive with an operational state that would be available in a standard variable displacement mode (i.e., where only a fixed set of cylinders are fired all of the time), it may be desirable to operate only a specific pre-designated sets of cylinders to mimic conventional variable displacement engine operation at such firing fractions.

The invention has been described primarily in the context of controlling the firing of 4-stroke piston engines suitable for use in motor vehicles. However, it should be appreciated that the described continuously variable displacement approaches are very well suited for use in a wide variety of internal combustion engines. These include engines for virtually any type of vehicle—including cars, trucks, boats, aircraft, motorcycles, scooters, etc.; for non-vehicular applications such as generators, lawn mowers, models, etc.; and virtually any other application that utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkins cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles.

Some of the examples in the incorporated patents and patent applications contemplate an optimized skip fire approach in which the fired working chambers are fired under substantially optimal conditions (thermodynamic or otherwise). For example, the mass air charge introduced to the working chambers for each of the cylinder firings may be set at the mass air charge that provides substantially the highest thermodynamic efficiency at the current operating state of the engine (e.g., engine speed, environmental conditions, etc.). The described control approach works very well when used in conjunction with this type of optimized skip fire engine operation. However, that is by no means a requirement. Rather, the described control approach works very well regardless of the conditions that the working chambers are fired under.

As explained in some of the referenced patents and patent applications, the described firing control unit may be implemented within an engine control unit, as a separate firing control co-processor or in any other suitable manner. In many applications it will be desirable to provide skip fire control as an additional operational mode to conventional (i.e., all cylinder firing) engine operation. This allows the engine to be operated in a conventional mode when conditions are not well suited for skip fire operation. For example, conventional operation may be preferable in certain engine states such as engine startup, low engine speeds, etc.

The described skip fire control can readily be used with a variety of other fuel economy and/or performance enhancement techniques—including lean burning techniques, fuel injection profiling techniques, turbocharging, supercharging, etc.

Most conventional variable displacement piston engines are arranged to deactivate unused cylinders by keeping the valves closed throughout the entire working cycle in an attempt to minimize the negative effects of pumping air through unused cylinders. The described embodiments work well in engines that have the ability to deactivate or shutting down skipped cylinders in a similar manner. Although this approach works well, the piston still reciprocates within the cylinder. The reciprocation of the piston within the cylinder introduces frictional losses and in practice some of the compressed gases within the cylinder will typically escape past the piston ring, thereby introducing some pumping losses as well. Frictional losses due to piston reciprocation are relatively high in piston engines and therefore, significant further improvements in overall fuel efficiency can theoretically be had by disengaging the pistons during skipped working cycles. In view of the foregoing, it should be apparent that the present embodiments should be considered illustrative and not restrictive and the invention is not to be limited to the details given herein, but may be modified within the scope of the appended claims.

What is claimed is:

1. A skip fire engine controller comprising:

a look-up table embodied in a computer readable media, the look-up table having a multiplicity of entries and wherein at least some of the entries include a first element that indicates a firing decision and a second element that includes indexing information that is at least sometimes used to determine a relevant lookup table entry for a next firing decision; and a firing controller arranged to direct firings in a skip fire manner that delivers a desired engine output, wherein the firing controller utilizes the look-up table to determine when firings are appropriate.

2. A skip fire engine controller as recited in claim 1 wherein the indexing information is an accumulator value indicative of a portion of a firing that represents a current cumulative difference between a requested engine output and a directed engine output.

3. A skip fire engine controller as recited in claim 2 wherein the accumulator value is sometimes negative.

4. A skip fire engine controller as recited in claim 2 wherein the accumulator value sometimes exceeds a full firing.

5. A skip fire engine controller as recited in claim 2 wherein indices for the lookup table include a desired firing fraction and a current accumulator value.

6. A skip fire engine controller as recited in claim 1 wherein:

the firing controller is arranged to direct firings in a skip fire manner that delivers a desired firing fraction; and each entry look-up table entry includes: (i) a firing indicator field arranged to store an associated firing indicator indicative of a firing decision, the firing indicator being the first element, and (ii) a second field arranged to store a second value that is used for accessing the lookup table at least when changing between desired firing fractions, the second value being the second element.

7. A skip fire engine controller as recited in claim 1 further comprising a firing fraction determining unit arranged to determine a desired operating firing fraction, and wherein:

the look-up table is a multi-dimensional look-up table having first and second indices; and the first index is based at least in part on the desired operating firing fraction.

8. A skip fire engine controller as recited in claim 1 wherein:

indices for the look-up table include desired firing fraction and current accumulator value; and each look-up table entry includes: (i) a firing indicator field arranged to store an associated firing indicator that indicates whether to fire or to skip a selected working cycle, the firing indicator being the first element; and (ii) an accumulator value field arranged to store an associated accumulator value indicative of a portion of a firing that represents a current cumulative difference between a requested engine output and a directed engine output, the accumulator value being the second element.

9. A skip fire engine controller as recited in claim 8 wherein an accumulator value from a look-up table entry associated with a first firing decision is used as an index when the lookup table is used to determine the next firing decision.

10. A skip fire engine controller as recited in claim 1 wherein each entry in the lookup table consists of an ordered number pair, with one element of the pair serving as a firing decision and the second element of the pair including information utilized in accessing the lookup table at the next firing decision.

11. A skip fire engine controller as recited in claim 1 wherein there are a plurality of look-up tables embodied in the computer readable medium, wherein each of the look-up tables is associated with selected operational power train parameters.

12. A skip fire engine controller as recited in claim 11 wherein the selected operational power train parameters include transmission gear.

13. A skip fire engine controller as recited in claim 11 wherein the selected operational power train parameters include selected ranges of engine speed.

14. An engine controller that includes a skip fire engine controller as recited in claim 1, the engine controller further being arranged to sometimes operate the engine in an all cylinder firing mode in which the output of the engine is primarily modulated based on throttle position.

15. A skip fire engine controller comprising:

a firing fraction determining unit arranged to determine a desired operating firing fraction;

a look-up table having a multiplicity of entries and wherein indices for the look-up table include desired firing fraction and a current accumulator value, each entry including: (i) a firing indicator field arranged to store an associated firing indicator that indicates whether to fire or to skip a working cycle; and (ii) an accumulator value field arranged to store an associated accumulator value indicative of a portion of a firing that has been requested, but not directed; and a firing controller arranged to direct firings in a skip fire manner that delivers the desired firing fraction, wherein the firing controller utilizes the look-up table to determine when firings are appropriate, the firing controller being arranged to use a current firing fraction request and an accumulator value associated with a prior firing decision as indices for the lookup table to facilitate making the next firing decision.

16. A skip fire engine controller as recited in claim 15 wherein the accumulator value may be negative.

17. A skip fire engine controller as recited in claim 15 wherein the accumulator value may sometimes exceed a full firing.

18. A method of controlling a skip fire engine in accordance with a predetermined control algorithm, wherein the control algorithm is implemented at least in part using a lookup table having a multiplicity of entries and wherein each entry includes a first element that indicates a firing decision and a second element that includes indexing information that is at least sometimes used to determine a relevant lookup table entry for a next firing decision.

19. A method of determining firings during operation of an engine in a skip fire operational mode, the method comprising:

determining a desired firing fraction; and accessing a multi-dimensional lookup table to determine specific firings, wherein the lookup table has a multiplicity of entries and wherein each entry includes indexing information that is at least sometimes used to determine a relevant lookup table entry for a next firing decision, wherein the desired firing fraction is utilized as a first index for the lookup table and wherein a second index is used for accessing the lookup table at least when changing between desired firing fractions.

20. A method as recited in claim 19 wherein an accumulator value indicative of a portion of a firing that has been requested but not yet delivered is used as the second index.

21. A method as recited in claim 19 further comprising:

receiving a signal indicative of a desired engine output; and determining selected engine settings, wherein the selected engine settings and the desired firing fraction are chosen such that the engine will deliver substantially the desired engine output when operating at the selected engine settings and the desired firing fraction.

22. A skip fire engine controller arranged to direct firings in a skip fire manner that delivers a desired engine output, wherein the skip fire engine controller utilizes a state machine to determine when firings are appropriate to deliver the desired engine output, wherein the state machine comprises a plurality of states and a plurality of transitions between different states.

23. A skip fire engine controller as recited in claim 22 wherein the transitions between states in the state machine are based at least in part on a value indicative of a portion of a firing that has been requested but not yet delivered.

24. A skip fire engine controller as recited in claim 23 wherein the transitions between states in the state machine are based at least in part on a requested firing fraction.

25. A skip fire engine controller as recited in claim 22 wherein the transitions between states in the state machine are based at least in part on a requested firing fraction.

26. A skip fire engine controller as recited in claim 22 further comprising:

a firing fraction determining unit arranged to determine a desired operating firing fraction based at least in part on the desired engine output; and a firing timing controller arranged to direct firings in a skip fire manner that delivers the desired firing fraction, wherein the firing controller utilizes the state machine to determine when firings are appropriate.

27. A method of controlling a skip fire engine wherein the sequence of the skip fire firings is determined through the use of a state machine, wherein the state machine comprises a plurality of states and a plurality of transitions between different states.

28. A method as recited in claim 27 further comprising:

determining a desired firing fraction that is suitable for delivering a desired output; and the state machine is arranged to deliver the desired firing fraction.

29. A method as recited in claim 27 wherein the transitions between states in the state machine are based at least in part on at least one of:

(i) a value indicative of a portion of a firing that has been requested but not yet delivered; and (ii) a requested firing fraction.

* * * * *